US009982852B2

(12) United States Patent
Haas

(10) Patent No.: US 9,982,852 B2
(45) Date of Patent: May 29, 2018

(54) LIGHT SLIDE SYSTEM AND METHOD

(71) Applicant: Arnold Haas, Columbus, OH (US)

(72) Inventor: Arnold Haas, Columbus, OH (US)

( * ) Notice: Subject to any disclaimer, the term of this patent is extended or adjusted under 35 U.S.C. 154(b) by 155 days.

(21) Appl. No.: 14/637,076

(22) Filed: Mar. 3, 2015

(65) Prior Publication Data

US 2016/0178144 A1 Jun. 23, 2016

Related U.S. Application Data

(60) Provisional application No. 62/092,957, filed on Dec. 17, 2014.

(51) Int. Cl.

| | |
|---|---|
| ***F21S 4/00*** | (2016.01) |
| ***F21S 4/10*** | (2016.01) |
| ***F21S 2/00*** | (2016.01) |
| ***F21V 21/005*** | (2006.01) |
| ***F21V 21/02*** | (2006.01) |
| *F21W 121/00* | (2006.01) |

(52) U.S. Cl.
CPC . *F21S 4/10* (2016.01); *F21S 2/00* (2013.01); *F21V 21/005* (2013.01); *F21V 21/02* (2013.01); *F21W 2121/004* (2013.01); *F21W 2121/006* (2013.01)

(58) Field of Classification Search
CPC ..... F21S 4/10; F21S 4/20; F21S 4/26; F21S 2/00; F21S 2/005; F21V 21/005
USPC ..... 362/249.01, 249.14, 217.1–217.16
See application file for complete search history.

(56) References Cited

U.S. PATENT DOCUMENTS

| | | | | |
|---|---|---|---|---|
| 6,652,112 | B1 * | 11/2003 | Lucarelli | F21V 21/08 362/145 |
| 2010/0200713 | A1 * | 8/2010 | Miller | E04D 13/064 248/220.21 |
| 2010/0226141 | A1 * | 9/2010 | Klein | B65H 75/36 362/382 |
| 2011/0122625 | A1 * | 5/2011 | Carone | F21S 4/10 362/249.14 |
| 2011/0164409 | A1 * | 7/2011 | Smith | F21V 21/00 362/145 |

* cited by examiner

*Primary Examiner* — Sean Gramling
*Assistant Examiner* — Gerald J Sufleta, II
(74) *Attorney, Agent, or Firm* — The Law Office of Patrick F. O'Reilly III, LLC

(57) ABSTRACT

A light installation system and method is described. The system employs a channel, at least one set of lights, at least one mount, and a wire housing tube. The at least one set of lights are configured to fit partially within the wire housing tube, and extend out of the wire housing tube via a series of exit holes arranged equidistant from one another on the bottom of each wire housing tube. Each of the wire housing tubes is configured to be placed in carefully spaced segments within the channel(s). The channel is configured to be mounted, via the at least one mount, to the gutter or soffit portion of a building structure. The wire housing tube is configured to rapidly and easily slide into the channel when decorating, and be removed from the channel quickly when taking down the at least one set of lights.

19 Claims, 5 Drawing Sheets

LIGHT SLIDE SYSTEM AND METHOD

CONTINUITY

This application is a non-provisional application of provisional application No. 62/092,957, filed on Dec. 17, 2014, and priority is claimed thereto.

FIELD OF THE PRESENT INVENTION

The present invention relates generally to decorative lighting, and more specifically, externally mounted outdoor lights configured with a longitudinal sliding enclosure encompassing the wiring of the lights, facilitating rapid assembly, placement, and removal of the lights with ease.

BACKGROUND OF THE PRESENT INVENTION

It is conventionally known that individuals the world over employ traditional strand lights as decorative lighting which is commonly installed or placed on or within a home for a temporary time period. In many countries, including the United States, light strands often lining green or white wire are known to be placed in windows, on the edges of buildings, homes, and other structures, as well as on trees. It is customary for these lights to be displayed for holiday seasons, and then removed after the holiday has passed.

Unfortunately, many individuals have difficulty both installing and removing the lights year after year, as the lights frequently and easily become tangled when placed in storage. Even when conventional strand lights are new out of the box, they require stretching and arranging of the lights, which often causes new lights to tangle as well. Time must be taken to untangle the strand lights, lengthening the installation process.

Additionally, conventional strand lights require hooks, nails, clasps, or other installation mechanism to be placed in semi-frequent intervals in order to maintain the strand lights in the desired position. These installation mechanisms are usually removed from the placement location each year, and must be reinstalled when the lights are desired the next year. This delays the installation process, making it difficult to successfully install multiple strands of lights without requiring large portions of time dedicated to untangling the lights, installing mounting or installation mechanisms, and placing the lights in position one segment at a time.

Thus, there is a need for a faster and easier system and method of installing decorative light strands into desired, fixed locations that eliminates the need to untangle the lights each year, nor reinstall mounting mechanisms every year. Such a system would preferably enable an individual to hang an entire light strand at once without assistance, while ensuring fixed, equidistant placement of the lights, especially in cases of icicle extension-based light strands.

SUMMARY OF THE PRESENT INVENTION

The present invention is a light installation system and method that facilitates the rapid placement and removal of strand lights conventionally used for decoration for a multitude of holidays around the world. The system employs a channel which is fixedly mounted to or near the soffit, conventionally found near the gutter of a home or building structure. The channel is preferably a semicircle with the shape of a semi-enclosed "C." The channel is configured to hold a wire housing tube which is smaller in diameter than that of the channel. To clarify, the channel is preferably configured to securely hold a wire housing tube such that the outer diameter of the wire housing tube is smaller than the inside diameter of the channel, but sufficiently larger than the opening along the channel which cause the channel to be 'C-shaped' rather than a fully formed circular tube. The channel is preferably mounted under the soffit such that the opening along the channel is oriented toward the ground. The desired overall length of the system is achieved by linking sections of the system of the present invention end-to-end, with each section consisting of at least one wire housing tube within a channel.

The wire housing tube has a hollow core, and is configured to hold at least one light strand within its core. A series of holes are drilled out of the wire housing tube in a line parallel to the axis of the hollow core, each equidistant from another, along a bottom of the wire housing tube. The light strands are equipped with a conventional central spine wire and icicle strands extending downward via gravity from the central spine wire. The hollow core of the wire housing tube is configured to house the central spine wire. Each hole of the series of holes on the wire housing tube is configured to permit one icicle strand to extend from the central spine wire, through the hole, and down towards the ground. The first and last holes of the series of holes along the length of the wire housing tube should preferably be positioned at one-half the distance between successive holes from each end, such that the space between the last hole of one section of wire housing tube is equidistant to the space between successive holes of the series of holes within each wire housing tube. The positioning of the first hole and the end hole ensures placement for the male and female ends (plugs) of the central spine wire, ensuring consistent spacing of each of the icicle strands.

Via the series of holes, each embodiment of the at least one icicle strand is equally spaced from a proximal embodiment of the at least one icicle strand, and is permitted to extend down freely without binding on proximal strands. During assembly, the wire housing tube housing the light strands is slid into the channel, immediately placing the lights in their desired position and spaced appropriately from each other. Additional segments of the wire housing tube are slid into the channel following the first iteration of the wire housing tube until the channel is full. An end cap is preferably placed on the end of the channel after each iteration of the wire housing tube is placed into position within the channel. The end cap serves to ensure the wire housing tube remains in position even in cases when the channel is mounted at an angle.

DETAILED DESCRIPTION OF THE PREFERRED EMBODIMENT

Figure 1:
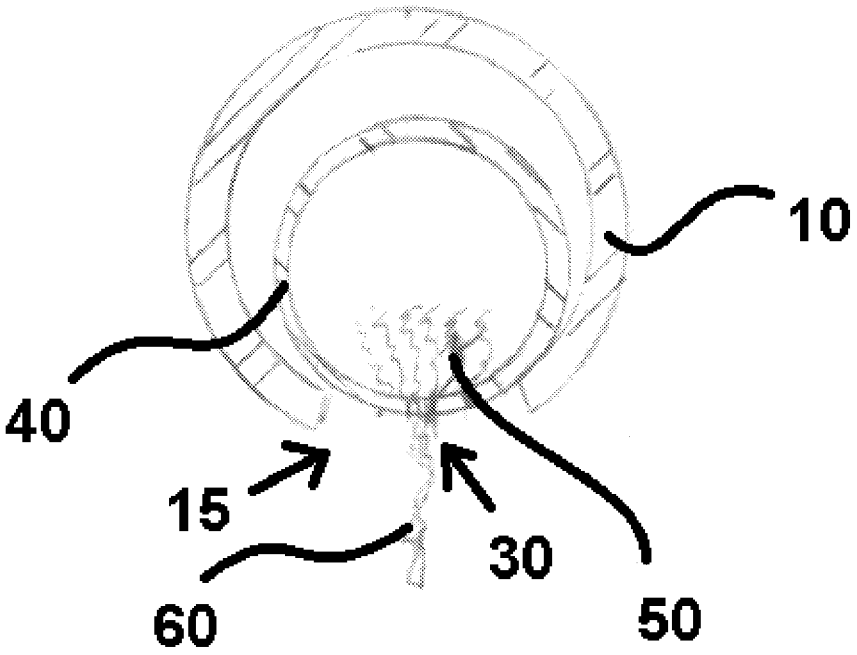
FIG. 1 displays a close up view of the wire housing tube and channel of the present invention as seen from the side.
Figure 2:
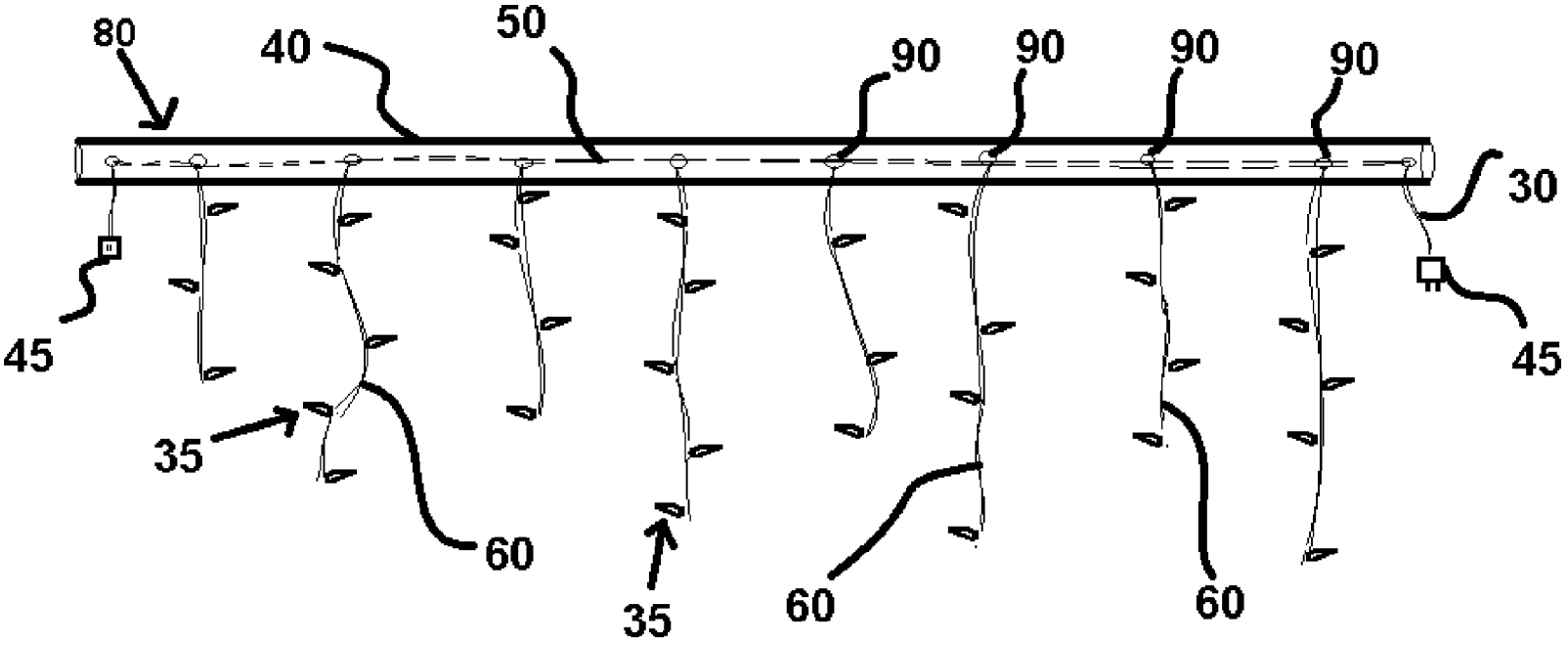
FIG. 2 exhibits a view of the present invention showing the wire housing tube with the icicle lights emerging from evenly spaced set of holes running along the bottom of the wire housing tube.
Figure 3:
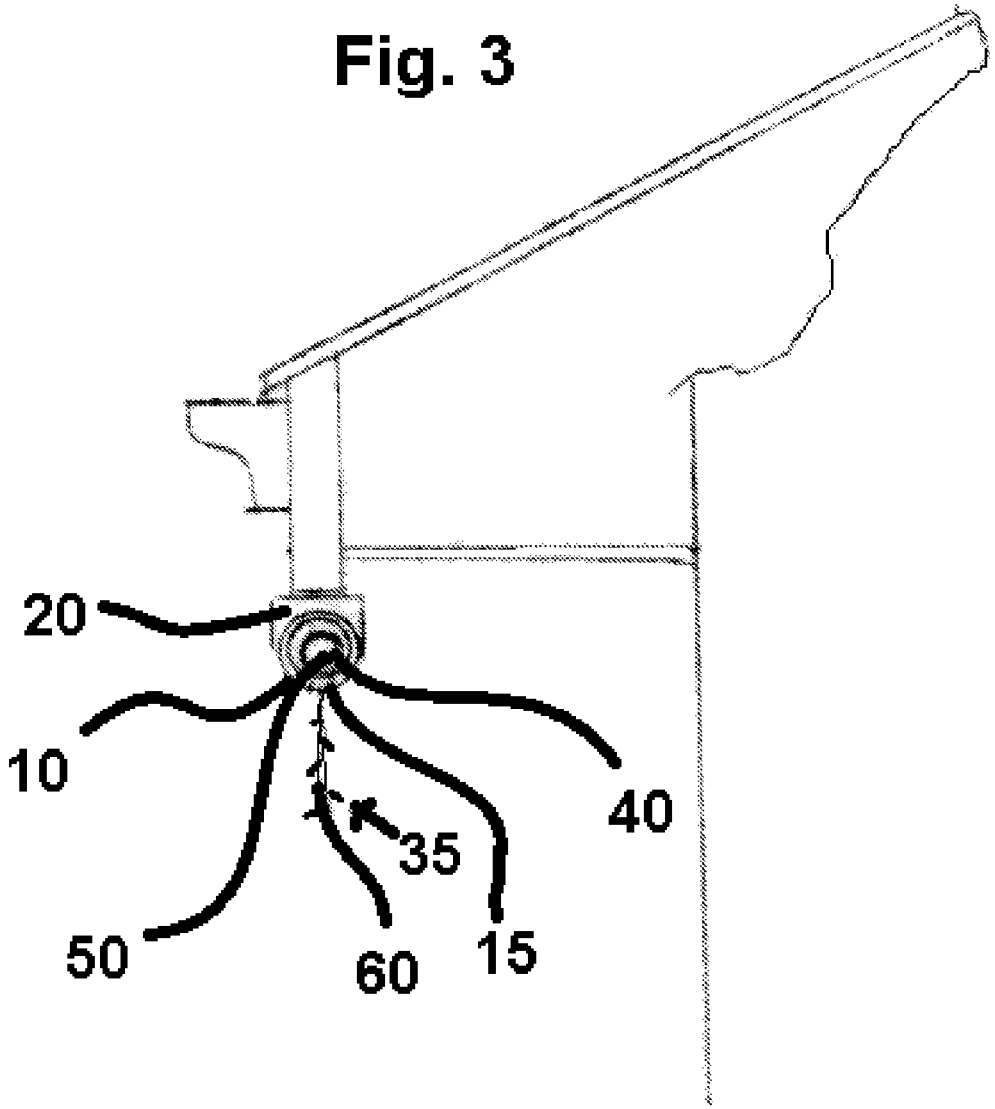
FIG. 3 shows an illustration of the channel installed in a desired position on a structure, as seen from the side.
Figure 4:
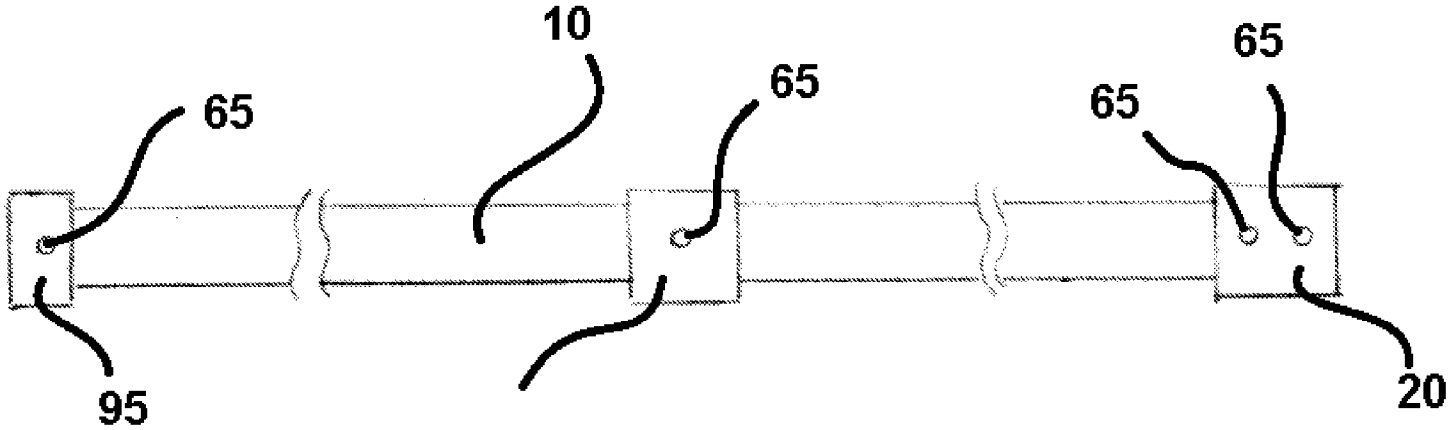
FIG. 4 displays the channel of the present invention with end cap and mounts, isolated from installation location, as seen from above.
Figure 5:
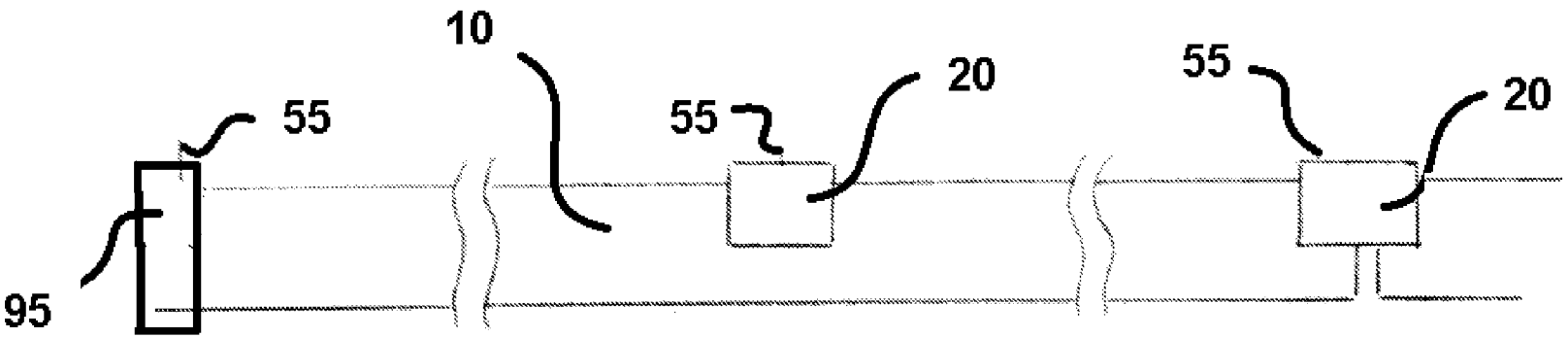
FIG. 5 displays the channel of the present invention with end cap and mounts, isolated from installation location, as seen from the side.
Figure 6:
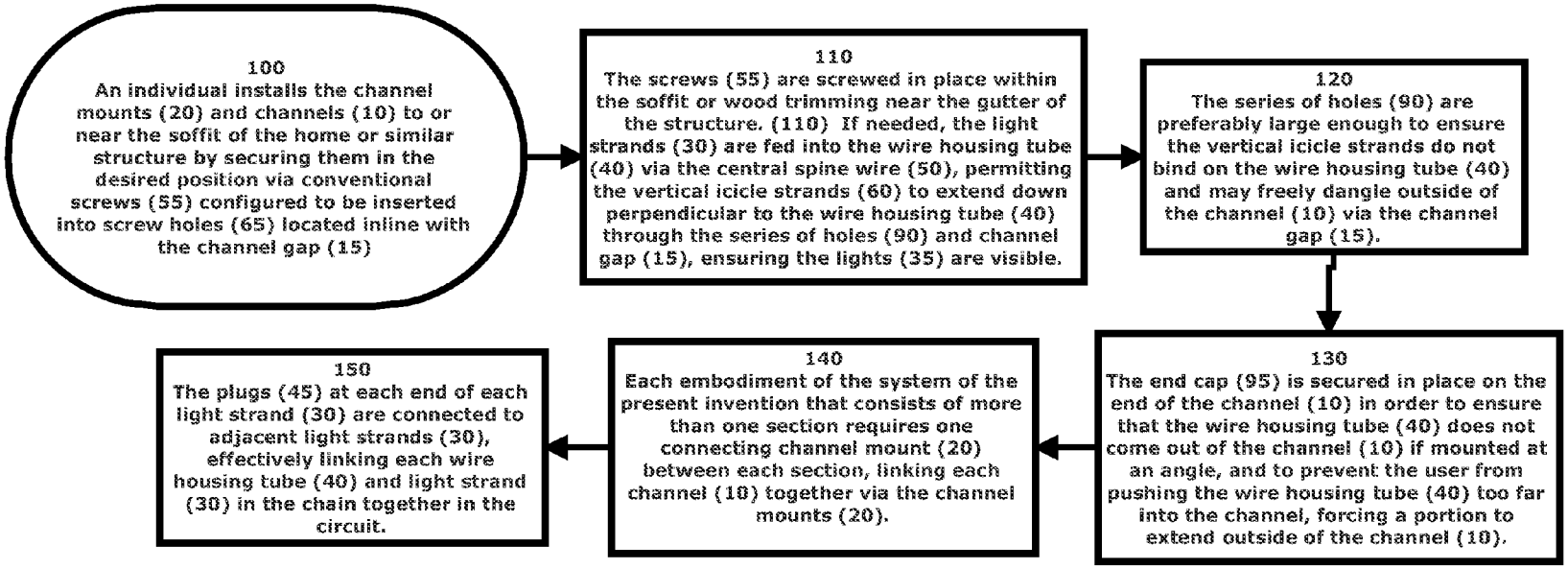
FIG. 6 is a flow chart detailing the installation process of use of the present invention.

The present invention is a light mounting and display system and method configured to drastically reduce the time required to install or remove decorative lighting in extended strips, such as along the rim of a roof, or the top of a building or similar structure. The preferred embodiment of the present invention includes a channel (10), channel mounts (20), lights (35), arranged into light strands (30), and a wire housing tube (40). The wire housing tube (40) has a wire housing tube top (70) and a wire housing tube bottom (80). A series of holes (90) are preferably drilled along the wire housing tube bottom (80) equidistant from one another. The light strands (30) are preferably conventional icicle strand lights that include alternating icicles containing four and six lights (35). Therefore, per convention, the light strands (30) are equipped with a central spine wire (50) and vertical icicle strands (60) extending downwards perpendicularly from the central spine wire (50).

The channel (10) of the present invention is preferably shaped as a semi-circle having a diameter less than that of the wire housing tube (40). The channel (10) is equipped with a channel gap (15) configured to permit wires of the light strands (30) to extend outside of the channel (10) via the channel gap (15) to power the vertical icicle strands (60). The wire housing tube (40) is preferably an enclosed tube with a hollow core. The hollow core is configured to contain the central spine wire (50) of each of the light strands (30) of the present invention. Per conventional light strands (30), the central spine wire (50) usually consists of two or more wires. The series of holes (90) are preferably drilled such that they are large enough for the vertical icicle strands (60) to fit within the diameter of each of the series of holes (90) without binding, causing excessive friction, or posing any similar risk. Each of the vertical icicle strands (60) often require two or three wires that are needed to convey power to the lights (35). Thus, each of the series of holes (90) is sized to permit passing of up to three wires. An end cap (95) is preferably placed on the end of the channel (10) after each instance of the wire housing tube (40) is placed into position within the channel (10). The end cap (95) serves to ensure the wire housing tube (40) remains in position, even in cases when the channel (40) is mounted at an angle, such as on a slanted roof.

Initial installation procedure of the present invention is preferably as follows:

First, an individual installs the channel mounts (20) and channels (10) to or near the soffit of the home or similar structure by securing them in the desired position via conventional screws (55) configured to be inserted into screw holes (65) located inline with the channel gap (15) (100).

The screws (55) are screwed in place within the soffit or wood trimming near the gutter of the structure. (110) If needed, the light strands (30) are fed into the wire housing tube (40) via the central spine wire (50), permitting the vertical icicle strands (60) to extend down perpendicular to the wire housing tube (40) through the series of holes (90) and channel gap (15), ensuring the lights (35) are visible. (110) The series of holes (90) are preferably large enough to ensure the vertical icicle strands do not bind on the wire housing tube (40) and may freely dangle outside of the channel (10) via the channel gap (15). (120) The end cap (95) is secured in place on an end of the channel (10) in order to ensure that the wire housing tube (40) does not come out of the channel (10) if mounted at an angle, and to prevent the user from pushing the wire housing tube (40) too far into the channel, forcing a portion to extend outside of the channel (10). (130)

The end cap (95) also functions as a channel mount (20) positioned solely at the end or final channel (10) within the circuit. Each embodiment of the system of the present invention that consists of more than one section requires one connecting channel mount (20) between each section, linking each channel (10) together via the channel mounts (20). (140) The plugs (45) at each end of each light strand (30) are connected to adjacent light strands (30), effectively linking each wire housing tube (40) and light strand (30) in the chain together in the circuit. (150)

For disassembly, the procedure is largely reversed. After initial setup, each of the light strands (30) may be left affixed to one another via the electrical outlet conventionally supplied to both ends of modern strand lights. In this manner, each of light strands (30) may be 'daisy-chained' or temporarily affixed to one another via plugs (45) which are preferably conventional electrical male and female plugs, ensuring rapid storage and removal of the wire housing tube (40) from the channel (10). Each iteration of the wire housing tube (40) containing the linked segments of the light strands (30) may be alternated, similar to an accordion or a 'Z' shape for easy storage, avoiding future tangles of the wire.

The color of each of the wire housing tubes (40) is irrelevant, as the wire housing tube (40) will be covered up by the channel (10) when installed in the desired position. However, the color of the channel (10) may vary according to the preference of the owner. Regarding the frequency or concentration of the lights (35), it is envisioned that approximately eighty lights (35) are configured to fit on the wire housing tube (40) that is sized four feet long, a standardized size in the preferred embodiment of the present invention. Due to the equidistant spacing found between each hole of the series of holes (90) of the wire housing tube (40), the present invention is configured to provide equal light density regardless of the size of the wire housing tube (40) embodiment purchased. This feature of the present invention solves the problem of light density differences that are evident when varying light strand sizes or manufacturing brands are combined and are used during conventional decorative light installation.

One embodiment of the present invention has a separation or small gap within the wire housing tube that runs perpendicular to the opening of the hollow core of the wire housing tube (40) that is displayed as a feint line going between the series of holes (90). The separation exists in alternate embodiments of the present invention to provide a means to manually insert or remove lights (30) into the hollow core of the wire housing tube (40) while ensuring that the vertical icicle strands (60) may pass into, or out of the preferred position within one of the series of holes (90) of the wire housing tube (40) of the present invention. When commercially available, it is envisioned that the end user need not employ such a separation or small gap within the wire housing tube (40), as the light strands (30) are preferably installed at the factory into the wire housing tube (40) wherein the initial gap in the tube may be sealed.

The present invention exhibits built-in wire protection within the wire housing tube (40), preventing the central spine wire (50) from wearing prematurely. The nature of the mounting system employed by the present invention ensures that the lights (35) and the entire apparatus of the present invention remains securely in position, even under intense weather conditions such as wind, snow, and rain. The present invention is configured to keep the light strands (30) dry, as it is envisioned that the present invention is preferably mounted under the gutter area of the building, near or on the soffit. It is envisioned that all embodiments of the present invention may be easily stored on a bicycle rack or conventional storage rack in a garage, and can be rapidly unfolded whenever they are needed. Complete installation of over 40 feet of lights takes approximately two minutes. Removal of the lights is similarly rapid to perform. Ideally, the installation of the channel (10) only must be done once, as it is non-intrusive, and may be left up year-round, further expediting the installation process each year. It is envisioned that the system of the present invention may be used multiple times per year to facilitate hanging of lights that correspond to the décor of the season or for a specific holiday.

Additionally, it is envisioned that end users may purchase alternate embodiments of the wire housing tube (40) as a replacement, update, or upgrade to their existing channel-based system of their initial purchase of the present invention. Thus, the wire housing tube (40) may be then used similar to a cartridge, easily replaced when needed, or changed for an alternate color, lighting style, or pattern when desired.

It should be noted that the overall structure of the system of the present invention can be best understood with reference to a cartridge system. Therefore, the channel (10) of the present invention is effectively a rail. As a counter part, the wire housing tube (40) is a cartridge for the system of the present invention, in reference to the intentional implication of the interchangeability of the wire housing tube (40) of the present invention. For example, an owner of the present invention may have numerous versions of the wire housing tube (40) and lights (35) mounted within the wire housing tube (40) that provide seasonal and holiday-based light colors, styles, and patterns. It should be understood that the channel (10) of the present invention remains inflexible at all times.

Effectively, after the channel (10) and channel mounts (20) of the present invention are installed in the desired position, a fixed rail is created, and the interchangeability of the wire housing tube (40) or cartridge becomes invaluable as the system becomes easily utilized for any and all holidays or occasions. These holidays are envisioned to extend beyond conventional Christmas and Hanukkah lights, including, but not limited to pink lights or heart-shaped bulbs for Valentine's Day, green lights for St. Patrick's Day, red/white/blue lights and star shaped-bulbs for Independence Day, orange and black lights for Halloween, and similarly color coordinated lights for holidays the world over.

In the preferred embodiment of the present invention, each of the lights (35) are configured to extend or hang below the channel (10). However, it can be envisioned in alternate embodiments of the present invention that the wire housing tube (40) and channel (10) of the present invention could be translucent or transparent, such as if it were composed of a transparent acrylic or similar plastic. As such, light omitted from lights (35) positioned within the wire housing tube (40) could be seen radiating from the present invention without the need for icicle style extended lighting. Similarly, alternate embodiments of the present invention may choose to forego the use of wire, rather employing a conductive metal tube or pipe to function in place of the wire housing tube (40). LED bulbs could then be soldered onto the metal tube, and illuminate when power is supplied to the metal tube. Such an arrangement of the present invention would employ a similarly transparent form of insulation Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A light mounting system for a structure comprising:

a channel, said channel forming a channel opening disposed at a first end of said channel, said channel further forming a channel gap extending axially from the channel opening;

a housing, said housing removably disposed within said channel, said housing conveying electricity via wires at least partially disposed within an axial cavity formed by said housing, at least a portion of said wires extending in an axial direction through said axial cavity;

wherein said housing forms a first housing opening and a second housing opening;

wherein said housing is configured to slide into said channel in an axial direction at the channel opening;

wherein an outer side wall surface of the housing and an inner side wall surface of the channel form a clearance space;

a light source, said light source in communication with said wires; and at least one channel mount.

2. The light mounting system of claim 1, wherein said channel is c-shaped.

3. The light mounting system of claim 1, wherein said channel opening is axially inline with said channel.

4. The light mounting system of claim 1, wherein said channel is rigid.

5. The light mounting system of claim 1, wherein said light source hangs from said housing.

6. The light mounting system of claim 1, wherein said light source is outside said channel.

7. The light mounting system of claim 2, wherein said channel is linear.

8. The light mounting system of claim 2, wherein said channel is rigid.

9. The light mounting system of claim 2, wherein said light source hangs from said housing.

10. The light mounting system of claim 3, wherein said channel is rigid.

11. The light mounting system of claim 3, wherein said light source hangs from said housing.

12. The light mounting system of claim 1, further comprising:

a series of holes disposed along a bottom of said housing inline with the primary axis of said housing;

wherein said channel is c-shaped;

wherein said channel opening is axially inline with said channel;

wherein said channel is linear;

wherein said channel is unitary;

wherein said light source hangs from a respective one of said series of holes of said housing and out from said channel gap towards the ground; and wherein said light source is outside said channel.

13. The light mounting system of claim 1, further comprising an end cap covering the channel opening.

14. The light mounting system of claim 1, further comprising at least one plug connected to the wires for conducting electricity.

15. A light mounting system for a structure, comprising:

a channel, said channel forming a channel opening disposed at a first end of said channel, said channel further forming a channel gap extending axially from the channel opening;

an end cap removably covering the channel opening;

a housing, said housing removably disposed within said channel, said housing conveying electricity via wires at least partially disposed within said housing, at least a portion of said wires extending in an axial direction within said housing, said housing further comprising at least one plug connected to the wires for conducting electricity;

at least one light source in communication with said wires, the at least one light source disposed outside the housing and the channel, said light source suspended by a portion of said wires, the portion of said wires passing through a hole in the housing and through the channel gap; and wherein an outer side wall surface of the housing and an inner side wall surface of the channel form a clearance space extending axially within said channel; and wherein said housing is sized to form said clearance space upon sliding into said channel in an axial direction at the channel opening.

16. The light mounting system of claim 15, further comprising a fastener passing through a side wall of the channel.

17. The light mounting system of claim 15, wherein the outer side wall surface of the housing is completely circumscribed within an outer side wall surface of the channel.

18. The light mounting system of claim 15, wherein the amount of clearance space toward the top of the housing is greater than the amount of clearance space toward the bottom of the housing.

19. A light mounting system for a structure, comprising:

a channel, said channel forming a channel opening disposed at a first end of said channel, said channel further forming a channel gap extending axially from the channel opening;

a housing, said housing removably disposed within said channel, said housing conveying electricity via wires at least partially disposed within an axial cavity formed by said housing, at least a portion of said wires extending in an axial direction through said axial cavity;

wherein said housing forms at least one housing opening;

wherein said housing is configured to slide into said channel in an axial direction at the channel opening;

wherein an outer side wall surface of the housing and an inner side wall surface of the channel form a clearance space; and a light source, said light source in communication with said wires, said light source suspended by a portion of said wires, the portion of said wires passing through a hole in the housing and through the channel gap.

* * * * *